US006929718B2

(12) United States Patent
Kimura

(10) Patent No.: US 6,929,718 B2
(45) Date of Patent: Aug. 16, 2005

(54) SHOE PRESS BELT

(75) Inventor: Keiichi Kimura, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 67 days.

(21) Appl. No.: 10/607,397

(22) Filed: Jun. 26, 2003

(65) Prior Publication Data

US 2004/0065427 A1 Apr. 8, 2004

(30) Foreign Application Priority Data

Jul. 1, 2002 (JP) ..... 2002-192272

(51) Int. Cl.[7] ..... D21F 3/04; D21F 7/08

(52) U.S. Cl. ..... 162/358.4; 162/358.3; 162/901; 428/167

(58) Field of Search ..... 162/306, 348, 162/358.1, 358.2, 358.3, 358.4, 900–904, 205, 361; 428/156, 157, 163, 167; 442/64–71, 104, 105; 100/37, 118, 121, 122, 153

(56) References Cited

U.S. PATENT DOCUMENTS 4,559,106 A * 12/1985 Skytta et al. ..... 162/358.3
4,908,103 A * 3/1990 Cronin et al. ..... 162/358.4
6,699,368 B2 * 3/2004 Ishii et al. ..... 162/358.4
2004/0026057 A1 * 2/2004 Watanabe et al. ..... 162/348

FOREIGN PATENT DOCUMENTS

DE 196 51 557 * 6/1998 ..... B30B/9/24
JP 2002-327389 * 11/2002 ..... D21F/3/00

* cited by examiner

*Primary Examiner*—Eric Hug
(74) *Attorney, Agent, or Firm*—Howson and Howson

(57) ABSTRACT

In a shoe press belt of a papermaking machine, the part of the paper web-facing layer in which water-holding grooves are formed is composed of a surface sublayer, having a relatively low hardness, and an underlying layer having a relatively high hardness. The higher hardness of the underlying layer prevents cracks from forming where the cross-sectional shape of the grooves tends to change as the belt is compressed. The lower hardness of the surface sublayer prevents the formation of cracks as a result of forces acting on the belt in the direction opposite to the machine direction at the nip location in a papermaking machine.

8 Claims, 6 Drawing Sheets

FIG.8

| | Low hardness section | High hardness section | Low hardness section : High hardness section | Time when cracks are generated | Place where cracks are generated |
|---|---|---|---|---|---|
| Example 1 | 93.5° | 94.5° | 1:1.5 | 450 | Side wall of groove |
| Example 2 | 93.5° | 94.5° | 1:5 | 450 | Side wall of groove |
| Example 3 | 93.5° | 94.5° | 1:9 | 450 | Land section |
| Comparative Example 1 | 93.5° | 94.5° | 1:1 | 300 | Side wall of groove |
| Comparative Example 2 | 93.5° | 94.5° | 1:10 | 350 | Land section |
| Example 4 | 93° | 95° | 1:1.5 | 500 | Side wall of groove |
| Example 5 | 93° | 95° | 1:5 | ≧500 | Not generated |
| Example 6 | 93° | 95° | 1:9 | 500 | Land section |
| Comparative Example 3 | 93° | 95° | 1:1 | 350 | Side wall of groove |
| Comparative Example 4 | 93° | 95° | 1:10 | 400 | Land section |
| Example 7 | 92° | 96° | 1:1.5 | 500 | Side wall of groove |
| Example 8 | 92° | 96° | 1:5 | ≧500 | Not generated |
| Example 9 | 92° | 96° | 1:9 | 500 | Land section |
| Comparative Example 5 | 92° | 96° | 1:1 | 350 | Side wall of groove |
| Comparative Example 6 | 92° | 96° | 1:10 | 400 | Land section |
| Comparative Example 7 | 92° | 92° | — | 250 | Bottom of groove |
| Comparative Example 8 | 96° | 96° | — | 300 | Land section |

SHOE PRESS BELT

FIELD OF THE INVENTION

This invention relates to a shoe press belt for use in the shoe press apparatus of a papermaking operation, and more particularly to the improvement of the durability of a shoe press belt.

BACKGROUND OF THE INVENTION

Shoe press apparatuses used in the press part of a papermaking machine are conventionally classified roughly into two types, one being shown in FIG. 1, and the other being shown in FIG. 2. In both apparatuses, a roll R is disposed in opposition to a shoe SH, and a pair of endless felts F1 and F2, and a shoe press belt 10A, are pinched between the roll and the shoe. A wet paper web P, from which water is to be removed, is held between the endless felts F1 and F2, and passes through a nip press section N provided by the roll R and the shoe SH. Water is removed from the wet paper web P as it passes through the nip. As shown in FIGS. 1 and 2, the roll R and the opposed shoe have conforming shapes, so that they approach each other closely over a relatively wide nip press section N, for a superior water-removing effect.

A relatively long shoe press belt is used in the apparatus of FIG. 1. This shoe press belt travels over a plurality of rolls r (5 rolls in FIG. 1), and is stretched to a predetermined tension. On the other hand, a relatively short shoe press belt is used in the apparatus of FIG. 2.

FIG. 3(*a*) is a cross-sectional view taken in the cross machine direction through a shoe press belt 10A of the kind conventionally used in a shoe press apparatus of the type shown in FIG. 1 or the type shown in FIG. 2. The belt 10A comprises a base or base body B, a wet paper web side layer 20, which is provided on one side of the base body B (the outer side of the endless loop when in use in a shoe press), and an opposite shoe side layer S, which is on the inner side of the endless loop when in use. The wet paper web side layer 20 and the shoe side layer S are composed of a high molecular weight elastic material. The high molecular weight elastic material is also provided in the base B. The high molecular weight elastic materials forming the shoe press belt 10A are integrated.

The base B is provided to impart strength to the shoe press belt 10A. The base may have any of a variety of constructions. For example, the base may be a woven fabric having a warp and weft, a fabric in which the warp and weft are stacked rather than woven, or a fabric comprising a narrow, strip of non-woven or woven fabric wound in a spiral.

In manufacture of the shoe press belt, the wet paper web side layer 20 and shoe side layer S may be provided on the base body B, either in successive steps or simultaneously. Appropriate high molecular weight elastic materials may be selected from rubber and various other elastomers. Polyurethane resins, and especially thermosetting urethane resins, have been adopted in many cases.

Water-holding concavities 40 are provided in the outer part 11 of the wet paper web side layer 20, for temporarily holding water removed from a wet paper web in a shoe press nip N as shown in FIGS. 1 and 2. The water held in the water-holding concavities 40 is shaken off from a shoe press belt 10A when the direction of travel of the shoe press belt 10A changes.

The water-holding concavities 40 are typically in the form of concave grooves which extend along the machine direction, but may consist of a plurality of separate blind holes formed in layer 20, which are no sufficiently deep to reach the base B. In FIG. 3(*a*), the water-holding concavities 40 have a cross-sectional shape in which the side walls are straight, and meet the bottoms of the concavities at a right angle. However, the water-holding concavities 40 may have various alternative cross-sectional shapes, as long as they are capable of holding water. For example, the concavities may have curved bottoms as shown in FIG. 3(*b*), or angled bottoms as shown in FIG. 3(*c*), or may be in the form of dovetailed grooves, having narrow entrances and larger inside spaces, as shown in FIGS. 3(*d*), 3(*e*) and 3(*f*).

The outer part 11 of the wet paper web side layer comprises not only water-holding concavities 40, but also projecting land sections 50, which are formed in the process of formation of the water-holding concavities 40.

In recent years, papermaking machines have been operated at increased speeds not previously encountered. The nip pressures in the shoe press have also been set to high levels in order to improve the productivity of paper making machines. There has been a need for a shoe press belt which has improved durability so that it is not readily broken under these more severe operating conditions.

When a relatively high pressure is applied to a shoe press belt 10A in the nip of the shoe press during use, a very high compressive load is applied to the belt in the direction of its thickness. Furthermore, a force is applied to the outer part 11 of the wet paper web side layer of the belt, the force being applied to the belt in a direction opposite to the machine direction. The application of a force in a direction opposite to the machine direction results from the fact that, as a part of the belt passes through the nip, a succeeding part is still in the nip. Thus, while the part exiting the nip travels in the machine direction, a load is applied to the succeeding part in the nip in the direction of the belt's thickness. Because this load acts as a braking force on the belt, it generates a load in a direction opposite the machine direction.

In the operation of a paper making machine, the very strong compressive load, which acts in the direction of the belt thickness, and a shear, which acts in the direction opposite to the machine direction, are repeatedly applied to the shoe press belt. These forces cause the high molecular weight elastic material to deteriorate gradually. After a time, the belt will no longer adequately absorb the compressive load and shear, and cracks are generated in the belt.

FIG. 4 is an explanatory view showing where cracks are generated in the case where the wet paper web side layer is composed of a high molecular weight elastic material having a low hardness. Since the hardness of the material is low, the land sections 50 are crushed in the nip, and the shape of the water-holding concavities 40 is warped remarkably. Cracks CR are generated at the corners 43, where the cross-sectional shape of the water-holding concavities 40 changes abruptly. On the other hand, the load applied to the land section 50 in the direction opposite to the machine direction is absorbed to some extent, since the material is flexible.

FIG. 5 is an explanatory view showing where cracks are generated when a wet paper web side layer is composed of a high molecular weight elastic material having a high degree of hardness. In this case, when a load is applied at the nip in the direction of the belt thickness, distortion of the water-holding concavities 40 is unremarkable, since the hardness of the belt is high. Therefore, cracks CR are not frequently generated in the water-holding concavities 40, as they are in the case of FIG. 4. On the other hand, since the hardness of material is high, and the load in the direction opposite to the machine direction may not be adequately absorbed, numerous cracks CR are generated in a surface sublayer 52 of the land section 50.

In view of the above problems, it is an object of the invention to provide a shoe press belt having a high durability, and to prevent the formation of cracks in the surfaces of the land section and at the corners of the water-holding concavities.

SUMMARY OF THE INVENTION

The belt in accordance with the invention, which is for use in the shoe press section of a papermaking machine, comprises a base, a wet paper web side layer on one side of the base, and a shoe side layer on the opposite side of the base. The wet paper web side layer comprises a high molecular weight elastic material, and has an outer surface composed of a land section and a concave water-holding section. The land section has a surface sublayer, and the concave water holding section has a portion that changes its cross-sectional shape as the belt is used in a shoe press. The hardness of the surface sublayer of the land section is relatively low compared to the hardness of said portion of the concave water holding section that changes its cross-sectional shape.

Preferably, the hardness of the surface sublayer of the land section is at most 94 degrees (JIS-A) and the hardness of the portion of the concave water-holding section that changes its cross-sectional shape is at least 94 degrees (JIS-A).

In a preferred embodiment, the water-holding section has a side wall comprising a low hardness section and high hardness section, and the ratio of the thickness of said low hardness section to the thickness of said high hardness section is between 1:9 and 1:1.5.

Since the hardness of the surface sublayer of the land section is lower than the hardness of the cross-sectional shape-changing portions of the water holding section, cracks in the cross-sectional shape-changing portion caused by loading in the thickness direction, and cracks at the surface the land section caused by loading in the direction opposite to the machine direction, are prevented, and the durability of the shoe press belt is remarkably improved.

BRIEF DESCRIPTION OF THE DRAWINGS

FIGS. 3(*b*)–3(*f*) are enlarged fragmentary cross-sectional views of water holding sections having various different cross-sections;

FIG. 6(*b*) is an enlarged fragmentary cross-sectional view showing a water-holding concavity provided in the surface of a wet paper web side layer of a shoe press belt in accordance with the invention;

FIG. 8 is a table showing the results of evaluations of conventional belts and belts in accordance with the invention, using a testing apparatus as depicted in FIG. 7.

DETAILED DESCRIPTION OF THE PREFERRED EMBODIMENTS

Figure 1:
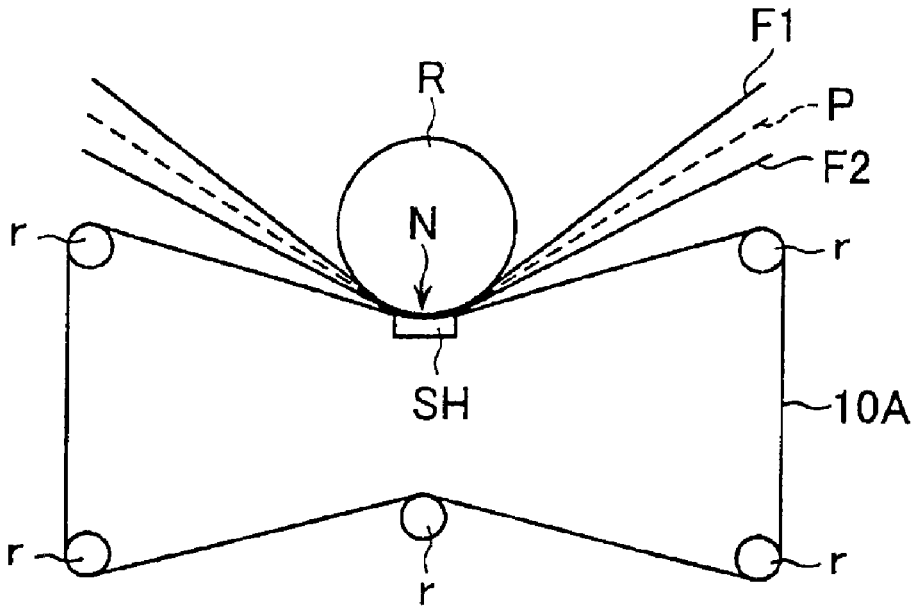
FIG. 1 is a schematic view of a shoe press apparatus utilizing a relatively long shoe press belt.
Figure 2:
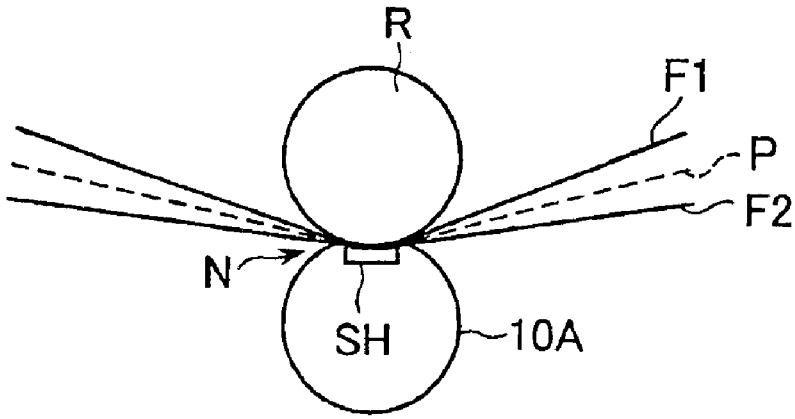
FIG. 2 is schematic view of a shoe press apparatus utilizing a relatively short shoe press belt.
Figure 3A:
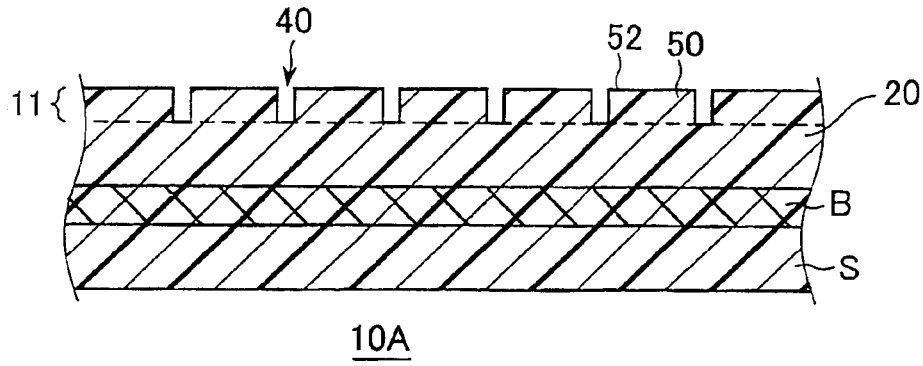
FIG. 3(*a*) is a fragmentary cross-sectional view of a conventional shoe press belt.
Figure 3B:
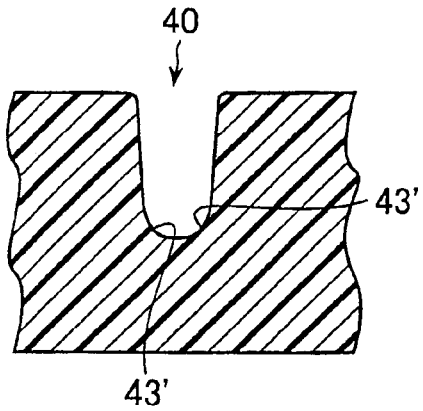
Figure 3B:
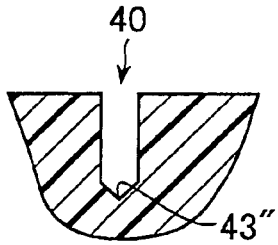
Figure 3D:
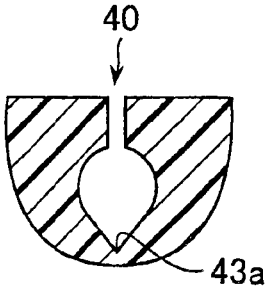
Figure 3E:
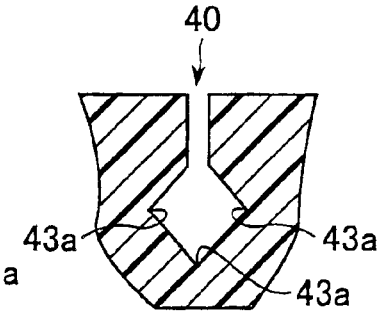
Figure 3F:
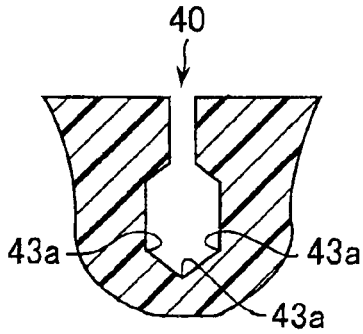
Figure 4:
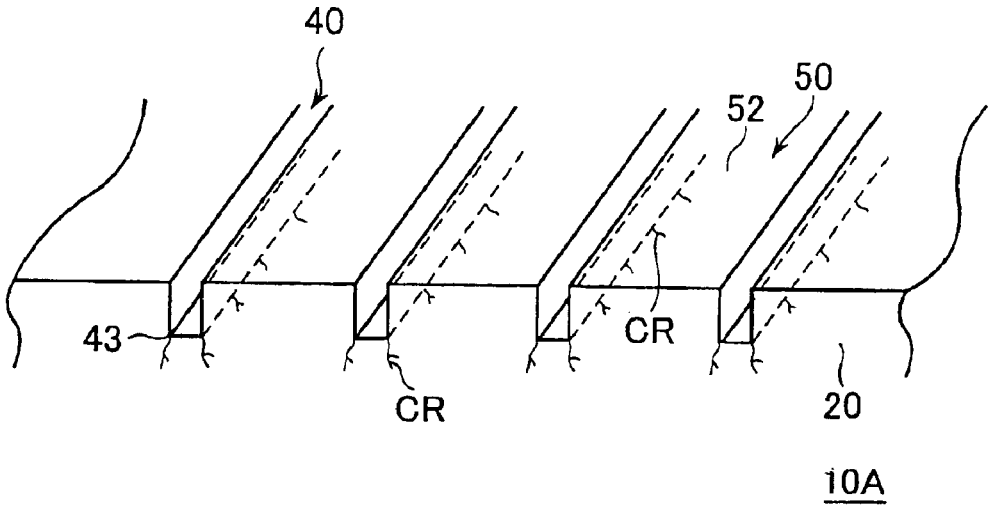
FIG.4 (PRIOR ART)
FIG. 4 is an explanatory schematic view of a shoe press belt showing where cracks are generated in the case where the wet paper web side layer is formed of a high molecular weight elastic material having a low degree of hardness.
Figure 5:
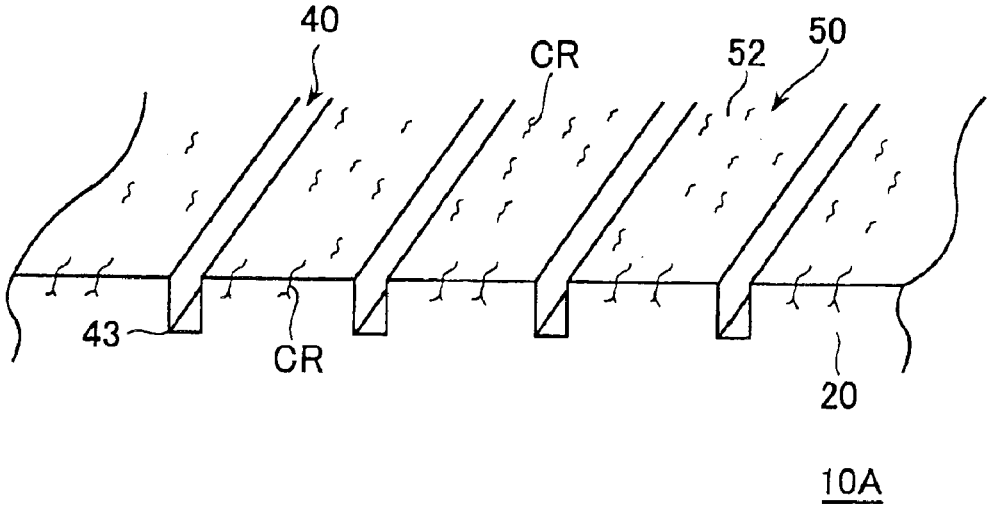
FIG.5 (PRIOR ART)
FIG. 5 is a similar explanatory schematic view of a shoe press belt showing where cracks are generated in the case where the wet paper web side layer is formed of a high molecular weight elastic material having a high degree of hardness.

An embodiment of a shoe press belt 10 according to the invention will be explained with reference to FIG. 6(*a*). Belt components and features corresponding to those of the conventional belt of FIG. 3 are designated by the same reference letters and numerals.

Shoe press belt 10 comprises a base B, a wet paper web side layer 20 provided on the outer side of the base B, and a shoe side layer S provided on the inner side of the belt. The wet paper web side layer 20 and the shoe side layer S are both composed, substantially entirely, of a high molecular weight elastic material. The outer part 11 of the wet paper web side layer 20 comprises a concave water holding section 40, and a land section 50, which is a projecting section formed in the process of formation of the water-holding section 40. The durability of the shoe press belt 10 may be improved by setting the hardness of a surface sublayer 52 of the land section 50 lower than the hardness of a cross-sectional shape-changing portion 43 of the water-holding section 40. The term "surface sublayer of the land section" refers to a portion which extends in the direction of thickness from the surface of the land section to a depth which does not reach the bottom of the water holding section.

In the manufacture of a shoe press belt 10 according to the invention, a wet paper web side layer 20 and a shoe side layer S are first provided on a base B. The wet web side layers and the shoe side layer may be formed independently, or, alternatively, both layers may be formed in successive steps. A high molecular weight elastic material having a high degree of hardness is used to form a section 31*b* of the wet paper web side layer 20.

Next, a high molecular weight elastic material having a lower degree of hardness is applied onto the high hardness section 31*b*, and then cured to form a low hardness section 31*a*. Thereafter, a water holding section 40 is formed in the outer part 11 of the wet paper web side layer. The parts of the low hardness section 31*a* that remain after the water holding section 40 is formed become a surface sublayer 52 of the land section 50.

Figure 6A:
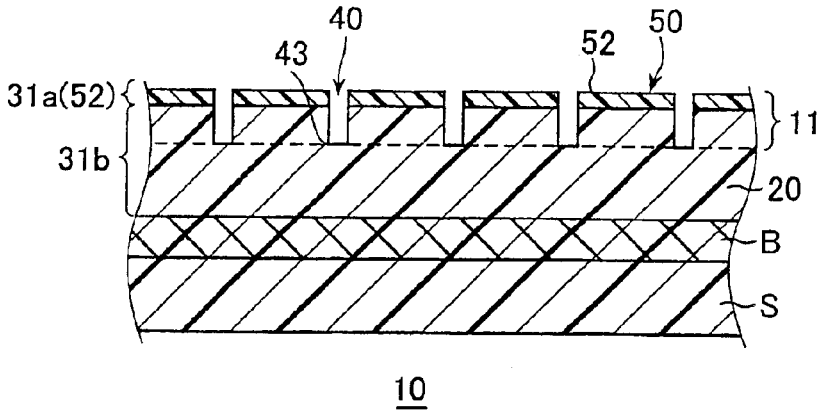
FIG. 6(*a*) is a fragmentary cross-sectional view of a shoe press belt in accordance with the invention.
Figure 6B:
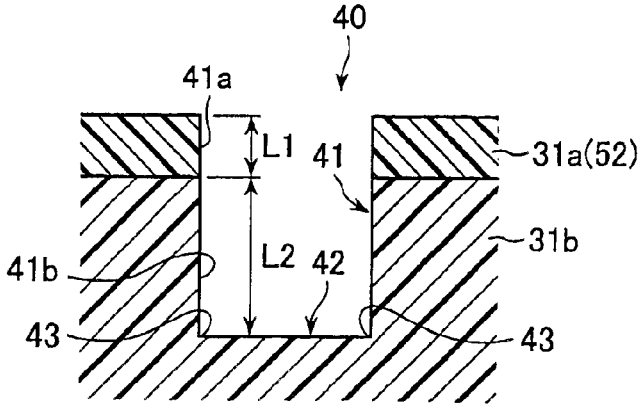

As shown in FIG. 6(*b*), the side wall 41 of a water-holding section 40 comprises a low hardness section 41*a* corresponding to low hardness section 31*a*, and high hardness section 41*b* corresponding to high hardness section 31*b*. A corner 43 which is a portion of the water holding section 40 that changes its cross-sectional shape, is formed in the high hardness section 31*b*. The cross-sectional shape changing portion 43, where cracks would otherwise occur most readily, is composed of the high hardness material of section 31*b*, and accordingly generation of cracks in the water holding section is effectively prevented.

Experiments have confirmed that the best effects are obtained when the hardness of the low hardness section 31*a* is not more than 94 degrees (JIS-A), preferably not more than 93 degrees, and the hardness of the high hardness section 31*b* is not less than 94 degrees, preferably not less than 95 degrees. The boundary between the high hardness and low hardness sections can be a distinct boundary, or, alternatively the hardness can change gradually from one section to the other section.

Experiments have also confirmed that it is preferable that the thickness ratio of the low hardness section 41*a* and the high hardness section 41*b*, (L1:L2 in FIG. 6(*b*)) be between 1:9 and 1:1.5.

With the belt structure as described above, as a load is applied in the direction of the thickness of the belt over a broad area of the land section 50, the generation of cracks in the water-holding section 40 is prevented since the cross-sectional shape-changing portions 43 of the water-holding section 40, where cracks are most readily generated, are formed in the high hardness section 31*b*. On the other hand, a load applied to the outer part 11 in a direction opposite to the machine direction, is absorbed, since the surface sublayer 52 of the land section is formed in the low hardness section 31*a*. Consequently the generation of cracks in the land section is also reduced.

In the embodiment described, the cross section of the water-holding section 40 is rectangular, the corner 43, where the side wall 41 and the bottom 42 meet, being in the form of a right angle. However, the invention is not limited to such a typical structure, and is applicable to water-holding sections having a wide variety of different cross-sectional shapes. In the case where the entire bottom of the water holding section 40 is curved, as in FIG. 3(*b*), a curve-shaped corner portion 43' which corresponds to corner 43 of FIG. 6(*b*), is a cross-sectional shape-changing portion. In the case where a water-holding section 40 has the bottom which is angled, as shown in FIG. 3(*c*), a portion 43" which is the corner of the angle at the bottom of the water-holding section, is the cross-sectional shape-changing portion. Where the water-holding section 40 is in the form of a dovetail groove, having a narrow entrance and large interior part, as shown in FIGS. 3(*d*)–3(*f*), portions 43*a* which are corners at or near the bottom of the water holding sections 40 are cross-sectional shape-changing portions. Whatever structure a water holding section 40 has, if the hardness of the surface sublayer of the land section is set lower than the hardness of the cross-sectional shape-changing portion of the water holding section, the desired effects of the invention may be obtained.

Nine specific examples of a shoe press belt in accordance with the invention, and eight comparative examples, will be explained referring to FIG. 8. The examples of the invention and the comparative examples had the following common features.

Width: 300 mm

Belt length 6 m

Thickness: 4.5 mm

Base B: warp-triple fabric woven with warp and weft, both comprising polyester monofilament yarns;

High molecular weight elastic material: thermosetting urethane comprising Adiprene L167 and Adiprene L100, from Uniroyal Chemical Company, mixed at a proper ratio so that the desired resin hardness is obtained, and to which Cuamine MT, from Ihara Chemical Industry Co., Ltd., was added;

Water holding section 40: grooves having a width of 1 mm, a depth of 1 mm, and a pitch of 2.5 mm, formed in a outer part 11 of the wet paper web side layer.

In Examples 1–9 and Comparative Examples 1–8, of the above structure, the hardness of the low hardness sections, the hardness of a high hardness sections, and thickness ratio of the low hardness sections and side high hardness sections, were varied. In Examples 1–3, and in Comparative Examples 1 and 2, the hardness of a low hardness section and high hardness section were 93.5 degrees and 94.5 degrees respectively. In Examples 4–6 and in Comparative Examples 3, 4, the hardness of the low hardness section and the hardness of the high hardness section were 93 degrees and 95 degrees, respectively. In Examples 7–9 and Comparative Examples 5 and 6, the hardness of the low hardness section and the hardness of the high hardness section were 92 degrees and 96 degrees, respectively. In Comparative Example 7 both of the sections corresponding to the low and high hardness sections of the preceding examples, had a hardness of 92 degrees, and in Comparative Example 8, both sections had a hardness of 96 degrees. The thickness ratios of the low hardness sections and high hardness sections, measured along the side walls of the water-holding sections, were 1:1.5 in Examples 1, 4, and 7; 1:5 in Examples 2, 5, and 8; 1:9 in Example 3, 6, and 9; 1:1 in Comparative Examples 1, 3, and 5; and 1:10 in Comparative Examples 2, 4, and 6.

Figure 7:
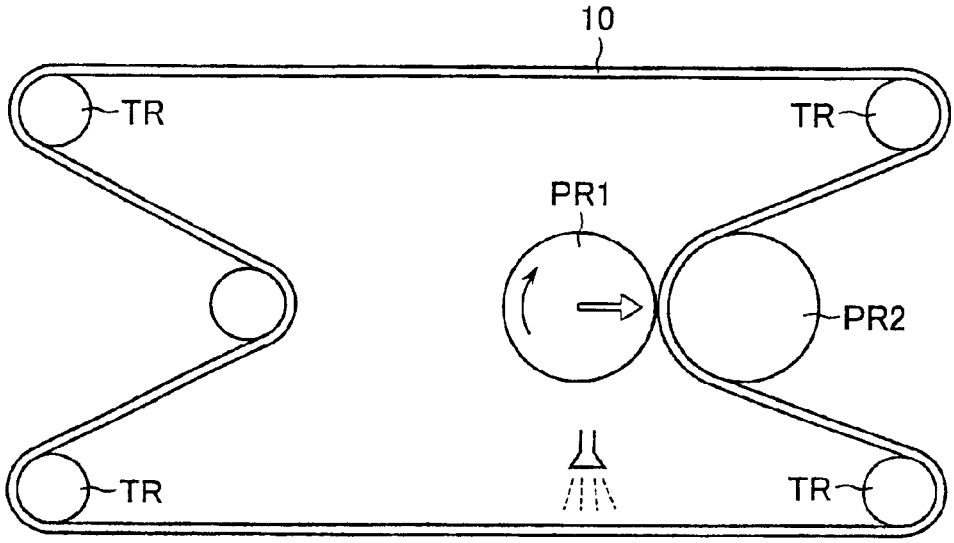
FIG. 7 is a schematic view of an apparatus used to evaluate the durability of shoe press belts.

Tests to evaluate the durability of the shoe press belts of Examples 1–9 and Comparative Examples 1–8 were conducted using an apparatus as shown in FIG. 7. The apparatus is a bending tester, comprising a plurality of tension rollers TR, and a pair of press rolls PR1 and PR2. The press roll PR1 is rotatable, and is movable relative to the press roll PR2. Therefore, it is possible to use the press rolls to apply pressure to a belt supported by the tension rollers TR. In the testing apparatus, the diameter of the tension roller TR was 100 mm, and the diameter of the press rolls PR1 and PR2 was 200 mm.

The shoe press belt was installed in the measuring apparatus with its water-holding section facing inward. As the belt traveled in the testing apparatus, in the state where water was supplied to the inner surface and the belt was stopped and observed every 50 hours. The time when cracks appeared was recorded. The running speed was 100 m/min. The pressure applied by the press rolls was 1000 KN/m. The belt tension was maintained at 20 KN/m.

As shown in the table in FIG. 8 the results of the experiments established that the Examples in accordance with the invention are superior in durability to the Comparative Examples.

In the shoe press belt according to the invention, since the hardness of a surface sublayer of a land section is set relatively low, and the hardness of the cross-sectional shape-changing portion of the water holding section is set relatively high, generation of cracks in the cross-sectional shape-changing portion of the water holding section, caused by the load applied in the direction of thickness is suppressed. In addition, generation of cracks in the surface of the land section caused by the load applied in the direction opposite to the machine direction are also suppressed. Therefore, the durability of the shoe press is remarkably improved.

What is claimed is:

1. A shoe press belt comprising a base B, a wet paper web side layer 20 on one side of the base, and a shoe side layer S on the opposite side of the base, in which:

said wet paper web side layer 20 comprises a high molecular weight elastic material, and has an outer surface, said outer surface being composed of a land section and a concave water-holding section;

said land section has a surface sublayer;

the concave water-holding section of said outer surface has a portion, separate from said surface sublayer, that has an abrupt change of direction; and the hardness of said surface sublayer of the land section is relatively low compared to the hardness of all of said high molecular weight elastic material of said wet paper web side layer other than said surface sublayer;

whereby said shoe press belt is resistant to the formation of cracks both in the land section and in said portion of the concave water-holding section that has an abrupt chance of direction.

2. A shoe press belt comprising a base B, a wet paper web side layer 20 on one side of the base, and a shoe side layer S on the opposite side of the base, in which:

said wet paper web side layer 20 comprises a high molecular weight elastic material, and has an outer surface, said outer surface being composed of a land section and a concave water-holding section;

said land section has a surface sublayer;

the concave water holding section of said outer surface has a portion, separate from said surface sublayer, that has an abrupt change of direction;

the hardness of said surface sublayer of the land section is relatively low compared to the hardness of all of said high molecular weight elastic material of said wet paper web side layer other than said surface sublayer; and said water-holding section has a side wall comprising a low hardness section and high hardness section, and the ratio of the thickness of said low hardness section to the thickness of said high hardness section is between 1:9 and 1:1.5;

whereby said shoe press belt is resistant to the formation of cracks both in the land section and in said portion of the concave water-holding section that has an abrupt change of direction.

3. A shoe press belt comprising a base B, a wet paper web side layer 20 on one side of the base, and a shoe side layer S on the opposite side of the base, in which:

said wet paper web side layer 20 comprises a high molecular weight elastic material, and has an outer surface, said outer surface being composed of a land section and a concave water-holding section;

said land section has a surface sublayer;

the concave water holding section of said outer surface has a portion, separate from said surface sublayer, that has an abrupt chance of direction;

the hardness of said surface sublayer of the land section is relatively low compared to the hardness of all of said high molecular weight elastic material of said wet paper web side layer other than said surface sublayer; and the hardness of said surface sublayer of the land section is at most 94 degrees (JIS-A) and the hardness of all of said high molecular weight elastic material of said wet paper web side layer other than said surface sublayer is at least 94 degrees (JIS-A);

whereby said shoe press belt is resistant to the formation of cracks both in the land section and in said portion of the concave water-holding section that has an abrupt change of direction.

4. A shoe press belt as claimed in claim 3, wherein said water-holding section has a side wall comprising a low hardness section and high hardness section, and the ratio of the thickness of said low hardness section to the thickness of said high hardness section is between 1:9 and 1:1.5.

5. A shoe press apparatus comprising a belt as claimed in claim 1, a press roll and a press shoe, wherein said belt is provided between said press roll and said shoe.

6. A shoe press apparatus comprising a belt as claimed in claim 2, a press roll and a press shoe, wherein said belt is provided between said press roll and said shoe.

7. A shoe press apparatus comprising a belt as claimed in claim 3, a press roll and a press shoe, wherein said belt is provided between said press roll and said shoe.

8. A shoe press apparatus comprising a belt as claimed in claim 4, a press roll and a press shoe, wherein said belt is provided between said press roll and said shoe.

* * * * *